US010570471B2

(12) United States Patent
Sasaki et al.

(10) Patent No.: US 10,570,471 B2
(45) Date of Patent: Feb. 25, 2020

(54) EQUIPMENT LINE FOR MANUFACTURING SEAMLESS STEEL TUBE OR PIPE AND METHOD OF MANUFACTURING HIGH-STRENGTH STAINLESS STEEL SEAMLESS TUBE OR PIPE FOR OIL WELLS USING THE EQUIPMENT LINE

(71) Applicant: JFE Steel Corporation, Tokyo (JP)

(72) Inventors: Shunsuke Sasaki, Tokyo (JP); Tatsuro Katsumura, Tokyo (JP); Hideto Kimura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 15/032,421

(22) PCT Filed: Sep. 25, 2014

(86) PCT No.: PCT/JP2014/004892
§ 371 (c)(1),
(2) Date: Apr. 27, 2016

(87) PCT Pub. No.: WO2015/064006
PCT Pub. Date: May 7, 2015

(65) Prior Publication Data

US 2016/0265076 A1 Sep. 15, 2016

(30) Foreign Application Priority Data

Oct. 29, 2013 (JP) ..... 2013-224235

(51) Int. Cl.
*B21B 45/00* (2006.01)
*C21D 9/08* (2006.01)
(Continued)

(52) U.S. Cl.
CPC ..... *C21D 9/085* (2013.01); *B21B 17/08* (2013.01); *B21B 19/04* (2013.01); *B21B 23/00* (2013.01);
(Continued)

(58) Field of Classification Search
CPC ..... B21B 17/02; B21B 17/04; B21B 17/06; B21B 17/08; B21B 17/10; B21B 17/12;
(Continued)

(56) References Cited

U.S. PATENT DOCUMENTS 4,075,041 A 2/1978 Ueno et al.
4,452,061 A * 6/1984 Numano ..... C21D 9/08 72/201
(Continued)

FOREIGN PATENT DOCUMENTS

CN 1836056 9/2006
DE 10 2010 008 389 8/2011
(Continued)

OTHER PUBLICATIONS

Japanese Office Action dated Jun. 14, 2016, of corresponding Japanese Application No. 2013-224235, along with a Concise Statement of Relevance of Office Action in English.
(Continued)

*Primary Examiner* — Debra M Sullivan
(74) *Attorney, Agent, or Firm* — Oliff PLC

(57) ABSTRACT

An equipment line for manufacturing a seamless steel tube includes a steel heating device, a piercing device that pierces the steel into a hollow steel tube, a rolling mill that forms the hollow steel tube into a seamless steel tube having a predetermined shape, and a cooling system arranged between the heating device and the piercing device or between the piercing device and the rolling mill.

2 Claims, 3 Drawing Sheets

(51) Int. Cl.

| | |
|---|---|
| ***B21B 45/02*** | (2006.01) |
| ***C21D 6/00*** | (2006.01) |
| ***C21D 8/10*** | (2006.01) |
| ***B21B 23/00*** | (2006.01) |
| ***C22C 38/00*** | (2006.01) |
| ***B21B 17/08*** | (2006.01) |
| ***B21B 19/04*** | (2006.01) |
| *C22C 38/02* | (2006.01) |
| *C22C 38/04* | (2006.01) |
| *C22C 38/06* | (2006.01) |
| *C22C 38/42* | (2006.01) |
| *C22C 38/44* | (2006.01) |
| *C22C 38/46* | (2006.01) |
| *C22C 38/48* | (2006.01) |
| *C22C 38/50* | (2006.01) |

(52) U.S. Cl.
CPC ..... *B21B 45/0203* (2013.01); *C21D 6/004* (2013.01); *C21D 6/005* (2013.01); *C21D 8/10* (2013.01); *C21D 8/105* (2013.01); *C21D 9/08* (2013.01); *C22C 38/00* (2013.01); *C22C 38/005* (2013.01); *C21D 2211/005* (2013.01); *C21D 2211/008* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search
CPC ..... B21B 45/0203; B21B 45/0215; B21B 45/008
See application file for complete search history.

(56) References Cited

U.S. PATENT DOCUMENTS 4,658,882 A * 4/1987 Oba ..... B21B 1/466 164/414
7,767,037 B2 * 8/2010 Kimura ..... C21D 1/25 148/325
2003/0066580 A1 4/2003 Miyata et al.
2006/0243354 A1 11/2006 Kimura et al.
2013/0333433 A1 * 12/2013 Kummerling ..... B21B 23/00 72/97
2014/0250965 A1 * 9/2014 Yamane ..... B21B 23/00 72/97

FOREIGN PATENT DOCUMENTS

| | | | |
|---|---|---|---|
| EP | 1 878 514 | | 1/2008 |
| EP | 1 288 316 | | 2/2009 |
| EP | 2 754 508 | | 7/2014 |
| JP | 5-195059 | A | 8/1993 |
| JP | 10-1755 | A | 1/1998 |
| JP | 2003-105441 | A | 4/2003 |
| JP | 2004-27351 | A | 1/2004 |
| JP | 2004-124188 | A | 4/2004 |
| JP | 2005-336595 | A | 12/2005 |
| JP | 2011-241477 | A | 12/2011 |
| JP | 2013-94826 | | 5/2013 |
| RU | 2 274 503 | | 6/2005 |
| RU | 2336133 | | 10/2008 |
| RU | 2 357 814 | | 6/2009 |
| SU | 852179 | | 7/1981 |
| WO | 03/057383 | | 7/2003 |

OTHER PUBLICATIONS

Supplementary European Search Report dated Jul. 27, 2016, of corresponding European Application No. 14857371.0.
Official Action dated Nov. 2, 2017, of related U.S. Appl. No. 15/031,247.
Russian Office Action dated Dec. 28, 2017, of corresponding Russian Application No. 2016121031 in English.
Russian Office Action dated Aug. 10, 2017, of corresponding Russian Application No. 201621031/02(033033), along with a Search Report in English.
Office Action dated May 24, 2018, of related U.S. Appl. No. 15/031,247.
Jul. 26, 2018 Office Action issued in European Patent Application No. 14857371.0.
Nov. 22, 2019 Office Action issued in European Patent Application No. 14857371.0.

* cited by examiner

EQUIPMENT LINE FOR MANUFACTURING SEAMLESS STEEL TUBE OR PIPE AND METHOD OF MANUFACTURING HIGH-STRENGTH STAINLESS STEEL SEAMLESS TUBE OR PIPE FOR OIL WELLS USING THE EQUIPMENT LINE

TECHNICAL FIELD

This disclosure relates to the manufacture of a seamless steel tube or pipe (hereafter, referred to as tube), and more particularly to an equipment line preferable for manufacturing a seamless steel tube, and a method of manufacturing a high-strength stainless seamless steel tube for oil wells having excellent low-temperature toughness using the equipment line.

BACKGROUND

Recently, from a view point of the high energy price of crude oil or the like and the exhaustion of oil resources due to the increase in energy consumption volume on a global scale, there has been observed the vigorous energy resource development with respect to oil fields having a large depth (deep layer oil fields) which had not been noticed, oil fields and gas fields in a severely corrosive environment which are in a so-called "sour" environment containing hydrogen sulfide or the like, and oil fields and gas fields in a far north region which is in a severe weather environment. Steel tubes for oil wells used in these oil fields and gas fields are required to have high strength, excellent corrosion resistance (sour resistance) and excellent low-temperature toughness.

Conventionally, in oil fields and gas fields in an environment containing carbon dioxide gas $CO_2$, chloride ions $Cl^-$ and the like, as an oil well tube used to drill, 13% Cr martensitic stainless steel tube has been popularly used. Recently, the use of improved version 13Cr martensitic stainless steel having a chemical composition, wherein the content of C is decreased and the contents of Ni, Mo and the like are increased, has been spreading.

For example, Japanese Patent Application Laid-open No. 10-1755 discloses a method of manufacturing a martensitic stainless steel (steel plate) wherein the corrosion resistance of 13% Cr martensitic stainless steel has been improved. The martensitic stainless steel disclosed in Japanese Patent Application Laid-open No. 10-1755 is manufactured by hot working a steel having a chemical composition containing by weight %, 10 to 15% Cr, 0.005 to 0.05% C, 4.0 to 9.0% Ni, 0.5 to 3% Cu, and 1.0 to 3% Mo, wherein the Ni equivalent amount is adjusted to −10 or more, followed by air-cooling to a room temperature, thereafter, heat treatment at a temperature equal to or above an Ac1 point at which an austenite fraction becomes 80% or less and, further, heat treatment at a temperature at which the austenite fraction becomes 60% or less. The thus manufactured martensitic stainless steel has a microstructure constituted of tempered martensitic phase, martensitic phase and retained austenitic phase, wherein the total fraction of tempered martensitic phase and martensitic phase becomes 60 to 90%. It is described in Japanese Patent Application Laid-open No. 10-1755 that the martensitic stainless steel enables corrosion resistance and sulfide stress corrosion cracking resistance in a wet carbon dioxide environment and a wet hydrogen sulfide environment to be improved.

Japanese Patent No. 5109222 (Japanese Patent Application Laid-open No. 2005-336595) discloses a method of manufacturing a high-strength stainless steel tube for oil wells having excellent corrosion resistance. The high-strength stainless steel tube disclosed in Japanese Patent No. 5109222 (Japanese Patent Application Laid-open No. 2005-336595) is manufactured by heating a steel having a chemical composition containing by mass %, 0.005 to 0.05% C, 0.05 to 0.5% Si, 0.2 to 1.8% Mn, 0.03% or less P, 0.005% or less S, 15.5 to 18% Cr, 1.5 to 5% Ni, 1 to 3.5% Mo, 0.02 to 0.2% V, 0.01 to 0.15% N, 0.006% or less o, wherein $Cr+0.65Ni+0.6Mo+0.55Cu-20C \geq 19.5$ and $Cr+Mo+0.3Si-43.5C-0.4Mn-Ni-0.3Cu-9N \geq 11.5$ are satisfied, followed by hot working into a seamless steel tube, cooling to a room temperature at a cooling rate equal to or above a cooling rate of air-cooling, reheating to a temperature of 850° C. or more, cooling down to a temperature equal to 100° C. or below at a cooling rate of air-cooling or more and, thereafter, quenching-tempering treatment where the seamless steel tube is heated to 700° C. or below. The high-strength stainless steel tube has a microstructure containing 10 to 60% of ferrite phase by a volume fraction and the balance being martensitic phase, and a yield strength of 654 MPa or more. It is described in Japanese Patent No. 5109222 (Japanese Patent Application Laid-open No. 2005-336595) that the high-strength stainless steel tube for oil wells has high strength, sufficient corrosion resistance also in a high temperature severe corrosion environment up to a temperature of 230° C. containing $CO_2$ and chloride ions $Cl^-$ and, further, high toughness with an absorbed energy of 50 J or more at a temperature of −40° C. in a Charpy impact test.

As a seamless steel tube for oil wells, it is necessary for the steel tube to have various wall thicknesses and diameters. In the manufacture of a heavy-walled seamless steel tube, when the steel tube is manufactured using conventional hot working, along with the increase in wall thickness of the steel tube, it is difficult to impart desired processing strain to the wall thickness center portion of the steel tube. Hence, there is a tendency for the microstructure of the wall thickness center portion of the steel tube to become coarse. Accordingly, the toughness of the wall thickness center portion of the heavy-walled steel tube is liable to be deteriorated compared to the toughness of the wall thickness center portion of a thin-walled steel tube. Japanese Patent Application Laid-open No. 10-1755 and Japanese Patent No. 5109222 (Japanese Patent Application Laid-open No. 2005-336595) aim at the application thereof to a steel tube having a wall thickness of 12.7 mm at maximum. Neither Japanese Patent Application Laid-open No. 10-1755 nor Japanese Patent No. 5109222 (Japanese Patent Application Laid-open No. 2005-336595) refers to the improvement of low-temperature toughness of heavy-walled seamless steel tube having a wall thickness exceeding 12.7 mm.

It could therefore be helpful to provide an equipment line for manufacturing a seamless steel tube which can manufacture a heavy-walled stainless seamless steel tube having excellent low-temperature toughness at a low cost. Further, it could be helpful to provide a method of manufacturing a high-strength heavy-walled stainless seamless steel tube for oil wells having a yield strength exceeding 654 MPa, excellent corrosion resistance in a hot corrosive environment and excellent low-temperature toughness at the wall thickness center portion thereof by making use of the equipment line. In this specification, "a heavy-walled seamless steel tube" means a seamless steel tube having a wall thickness exceeding 13 mm and equal to 100 mm or less.

SUMMARY

We thus provide:

(1) An equipment line for manufacturing a seamless steel tube, having;

a heating device for heating a steel, a piercing device for piercing the steel into a hollow steel tube, and a rolling mill for forming the hollow steel tube into a seamless steel tube having a predetermined shape, wherein a cooling system is arranged between the heating device and the piercing device or between the piercing device and the rolling mill.

(2) The equipment line for manufacturing a seamless steel tube described in (1), wherein the cooling system has a cooling power for cooling the outer surface of steel at an average cooling rate of 1.0° C./s or more.

(3) The equipment line for manufacturing a seamless steel tube described in (1) or (2), wherein a thermal insulator is arranged on an exit side of the rolling mill.

(4) A method of manufacturing a high-strength stainless seamless steel tube for oil wells by making use of the equipment line described in anyone of (1) to (3), comprising:

heating a steel in the heating device, piercing the steel in the piercing device into a hollow steel tube, cooling the hollow steel tube in the cooling system and, forming the hollow steel tube in the rolling mill into a seamless steel tube having a predetermined shape, or further passing the seamless steel tube through the thermal insulator, wherein the steel has a chemical composition consisting of by mass %, 0.050% or less C, 0.50% or less Si, 0.20 to 1.80% Mn, 15.5 to 18.0% Cr, 1.5 to 5.0% Ni, 1.0 to 3.5% Mo, 0.02 to 0.20% V, 0.01 to 0.15% N, 0.006% or less O, and Fe and unavoidable impurities as a balance, the heating in the heating device is performed such that the steel is heated to a temperature which falls within a range from 600° C. to a temperature below a melting point of the steel, and the cooling in the cooling system is performed such that the hollow steel tube after piercing is subjected to cooling at an average cooling rate of 1.0° C./s or more on the outer surface of steel until a cooling stop temperature of 600° C. or above and in a cooling temperature range of 50° C. or more between a cooling start temperature and the cooling stop temperature. Here, the cooling start temperature is defined as the surface temperature of the hollow steel tube before cooling is started in the cooling system.

(5) The method of manufacturing a high-strength stainless seamless steel tube for oil wells described in (4), wherein the seamless steel tube is passed through the thermal insulator to be cooled at an average cooling rate of 20° C./s or less.

(6) The method of manufacturing a high-strength stainless seamless steel tube for oil wells described in (4) or (5), wherein the chemical composition further contains by mass %, at least one group selected from the following groups A to D;

Group A: 0.002 to 0.050% Al,

Group B: 3.5% or less Cu,

Group C: at least one element selected from 0.2% or less Nb, 0.3% or less Ti, 0.2% or less Zr, 3.0% or less W and 0.01% or less B, Group D: at least one element selected from 0.01% or less Ca, and 0.01% or less REM (rare-earth metal).

A heavy-walled high-strength stainless seamless steel tube having excellent low-temperature toughness can be easily manufactured thus acquiring industrially outstanding advantageous effects. Further, the microstructure of steel tube can be made fine even at the wall thickness center portion thereof with a relatively small amount of hot working. Accordingly, we can acquire an advantageous effect that low-temperature toughness can be enhanced even with respect to a heavy-walled seamless steel tube where the amount of hot working at the wall thickness center portion cannot be increased.

REFERENCE SIGN LIST

Figure 1A:
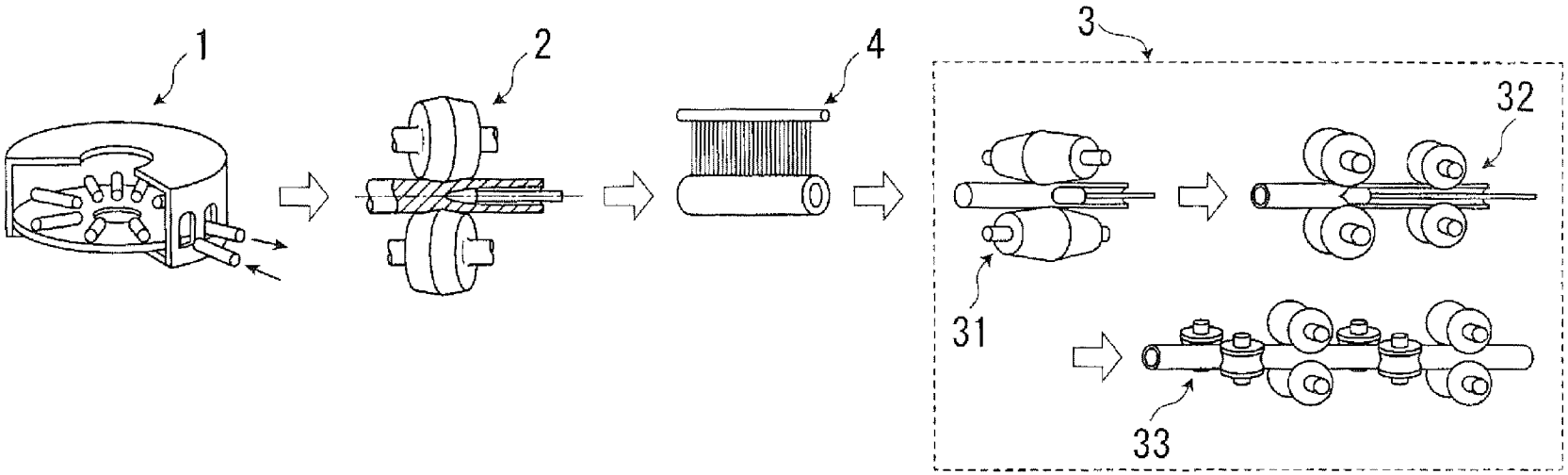
FIG. 1A is an explanatory view schematically showing one example of the equipment line for manufacturing a seamless steel tube.

1 heating device
2 piercing device
3 rolling device
4 cooling system
31 elongator
32 plug mill
33 sizer (sizing mill) (sizer)

DETAILED DESCRIPTION

We studied various factors influencing toughness at the wall thickness center portion of a heavy-walled stainless seamless steel tube. As a result, we had an idea that the most effective method of improving toughness is to make a microstructure fine.

We found that the microstructure of the heavy-walled martensitic stainless seamless steel tube can be made fine by applying cooling to a hollow steel tube obtained by piercing in a temperature region of 600° C. or above and at least within a temperature range of 50° C. or above at an average cooling rate of 1.0° C./s or more which is a cooling rate equal to or more than an air-cooling rate, and by applying wall thickness reduction or forming to the hollow steel tube so that the heavy-walled stainless seamless steel tube having a wall thickness exceeding 13 mm can remarkably enhance low-temperature toughness even at the wall thickness center portion thereof.

This is first explained by an experiment. A specimen was sampled from a martensitic stainless seamless steel tube for oil wells having a chemical composition consisting of by mass %, 0.017% C, 0.19% Si, 0.26% Mn, 0.01% P, 0.002% S, 16.6% Cr, 3.5% Ni, 1.6% Mo, 0.047% V, 0.047% N, 0.01% Al, and Fe as a balance. The sampled specimen was heated to a heating temperature of 1250° C. and held at the heating temperature for a predetermined time (60 min). Thereafter, the specimen was cooled at various cooling rates to a cooling stop temperature of 1200 to 600° C. at which hot working was carried out. After cooling, the specimen was immediately quenched to freeze the microstructure.

Then, the obtained specimen was polished and corroded (corrosion liquid: vilella (1% of picric acid, 5 to 15% of hydrochloric acid, and ethanol)) to observe the microstructure and measure an area ratio of martensitic phase and that of ferrite phase. The martensitic phase was formed by quenching due to the transformation of austenitic phase present at the cooling stop temperature. The obtained result is shown in FIG. 2 exhibiting the relationship between average cooling rate and amount of ferrite (ferrite area ratio) at each cooling stop temperature.

Figure 2:
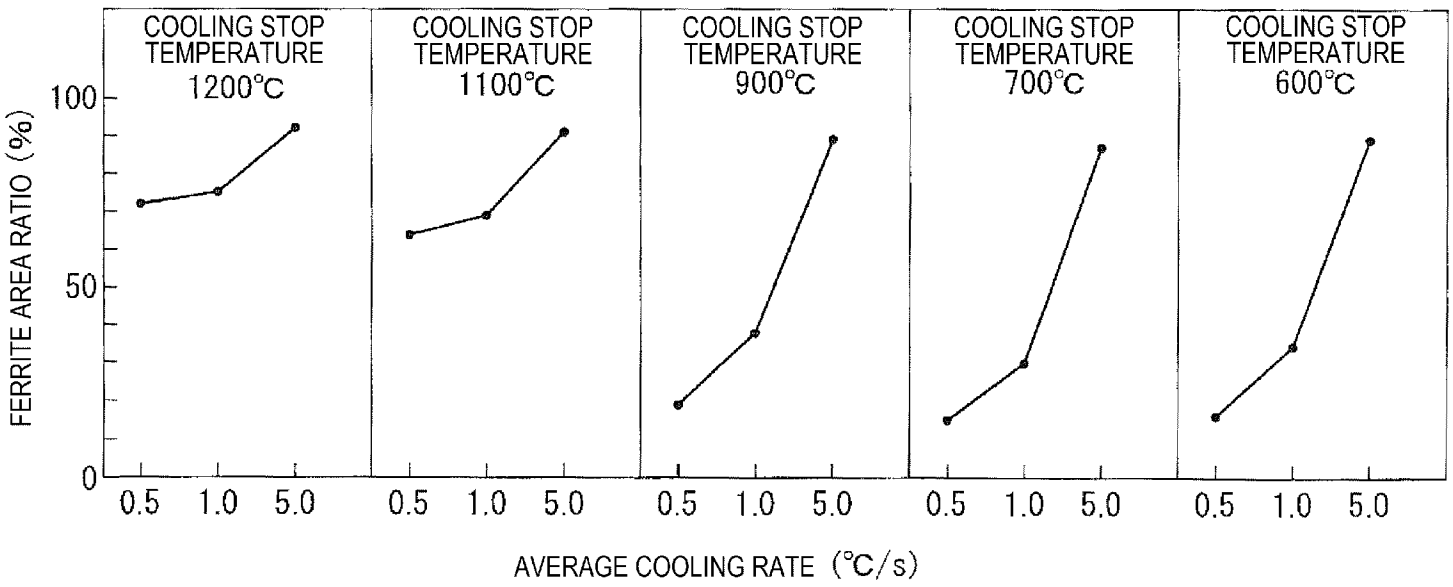
FIG. 2 is a graph showing the relationship between average cooling rate and ferrite area ratio at each cooling stop temperature before hot working.

FIG. 2 shows that by cooling the specimen at an average cooling rate of 1.0° C./s or more in a temperature range from the heating temperature to each cooling stop temperature (hot working temperature), the ferrite area ratio becomes larger than the ferrite area ratio obtained by cooling the specimen at an average cooling rate of 0.5° C./s regardless of the cooling stop temperature. Cooling at the average cooling rate of 0.5° C./s is cooling which simulates air-cooling (corresponding to air-cooling). Hence, it is possible to say that the cooling at the average cooling rate of 0.5° C./s is cooling under the condition close to equilibrium state.

That is, in a martensitic stainless steel having the above-mentioned chemical composition, usually, the fraction of ferrite phase is high in the heating temperature region, and when the steel is cooled from the heating temperature at a cooling rate substantially equal to a cooling rate of air-cooling, along with lowering of the temperature, the fraction of the ferrite phase is decreased and the fraction of austenitic phase is increased. However, by performing accelerated cooling at an average cooling rate of 1.0° C./s or more in a temperature range from the heating temperature to the hot working temperature (cooling stop temperature), the precipitation of austenitic phase can be delayed so that the microstructure having a phase distribution in a non-equilibrium state where the ferrite phase remains in a large amount compared to that in an equilibrium state can be acquired.

We also had an idea that the microstructure can be made fine by applying hot working (rolling) to such a steel having the microstructure in a non-equilibrium state. That is, by applying strain to ferrite phase present in a non-equilibrium state, a large number of nucleation sites for a γ transformation can be formed and, as a result, austenite phase formed after transformation is made fine whereby low-temperature toughness of stainless steel is enhanced.

We further found that, to realize the manufacture of a stainless seamless steel tube for oil wells having excellent low-temperature toughness by taking account of such a phenomenon, it is important to change a conventional equipment line where a heating device, a piercing device and a rolling mill are arranged in this order to an equipment line where a cooling system is arranged between the heating device and the piercing device or between the piercing device and the rolling mill.

Figure 1B:
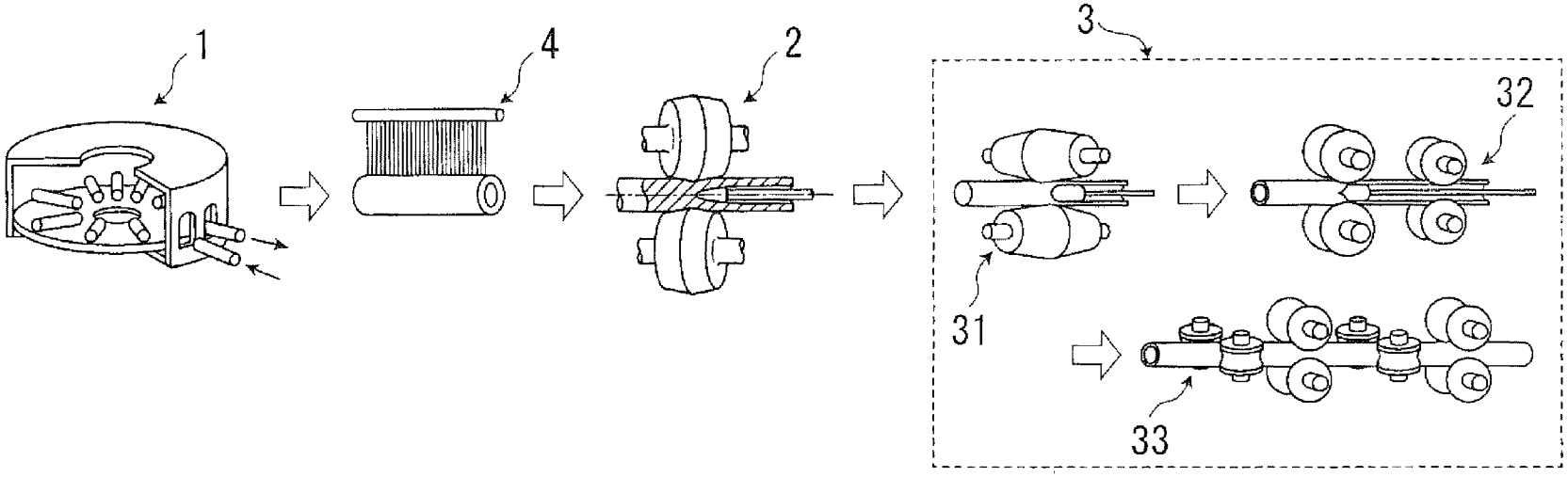
FIG. 1B is an explanatory view schematically showing another example of the equipment line for manufacturing a seamless steel tube.

The equipment line for manufacturing a seamless steel tube is an equipment line where a heated steel is cooled within a proper temperature range and, thereafter, hot working is applied to the steel so that the steel is formed into a seamless steel tube. One example of the equipment line for manufacturing a seamless steel tube is shown in FIGS. 1A and 1B. The equipment line for manufacturing a seamless steel tube is, as shown in FIG. 1A, a heating device 1, a piercing device 2, a cooling system 4 and a rolling mill 3 arranged in this order. Alternatively, as shown in FIG. 1B, the equipment line for manufacturing a seamless steel tube is a heating device 1, a cooling system 4, a piercing device 2, and a rolling mill 3 arranged in this order.

The heating device 1 can heat a steel such as a round slab or a round billet to a predetermined temperature. For example, any one of ordinary heating furnaces such as a rotary hearth furnace or a walking beam furnace can be used as the heating device 1. Further, an induction heating furnace may be used as the heating device 1.

It is sufficient that the piercing device 2 is one which can pierce the heated steel into a hollow steel tube. For example, any one of commonly known piercing devices such as a Mannesmann inclined roll type piercing machine which uses barrel shape rolls or the like or a hot extrusion type piercing machine can be used.

Further, it is sufficient that the rolling mill 3 is one which can form the hollow steel tube into a seamless steel tube having a predetermined shape. That is, depending on the purpose, for example, all commonly known rolling mills can be used. The commonly known rolling mill which is used as the rolling mill 3 may be one in which an elongator 31, a plug mill 32 which stretches the pierced hollow steel tube into a thin and elongated tube, a reeler (not shown in the drawing) which makes the inner and outer surfaces of the hollow steel tube smooth, and a sizer 33 which reshapes the hollow steel tube into a predetermined size are arranged in this order. The commonly known rolling mill used as the rolling mill 3 may also be one in which a mandrel mill (not shown in the drawing) that forms the hollow steel tube into a steel tube having a predetermined size, and a reducer (not shown in the drawing) that adjusts an outer diameter and a wall thickness of the steel tube by performing a slight rolling reduction are arranged. The rolling mill 3 may preferably be an elongator or a mandrel mill that allows a large amount of hot working.

To acquire a phase distribution in a non-equilibrium state, the cooling system 4 is arranged between the heating device 1 and the piercing device 2 or between the piercing device 2 and the rolling mill 3. The type of the cooling system 4 is not particularly limited provided that the cooling system can cool a heated steel at a desired cooling rate or more. As a cooling system that can ensure a desired cooling rate relatively easily, it is preferable to use a system of a type performing cooling by jetting out or supplying cooling water, compressed air or mist to both outer and inner surfaces of heated steel or hollow steel tube.

In manufacturing a steel tube having a stainless steel chemical composition, to acquire a phase distribution in a non-equilibrium state, it is necessary that the cooling system 4 is a system having a cooling power capable of acquiring an average cooling rate of at least 1.0° C./s on the outer surface of steel. When the cooling power is insufficient so that it is only possible to perform cooling at a cooling rate lower than the above-mentioned average cooling rate, the phase distribution in a non-equilibrium state cannot be acquired. Hence, even when hot working is performed thereafter, the microstructure of steel cannot be made fine. Although it is unnecessary to particularly define an upper limit of the cooling rate, it is preferable to set the upper limit of the cooling rate to 30° C./s from a viewpoint of preventing the occurrence of cracks or bending due to thermal stress.

It is preferable to adopt the equipment line where a thermal insulator (not shown in the drawing) is arranged on an exit side of the rolling mill 3. The thermal insulator is arranged to slow down the cooling rate after rolling. In a stainless steel tube, when cooling is performed at an excessively high rate after hot working, a non-equilibrium ferrite phase is cooled without transformation from α (alpha) (ferrite) to γ (gamma) (austenite), resulting that desired fine austenite grains cannot be generated whereby the microstructure of steel tube cannot be made fine as desired. It is sufficient for the thermal insulator to possess a temperature holding ability capable of adjusting a cooling rate to approximately 20° C./s or less with respect to a temperature on the surface of steel.

Next, the explanation is made with respect to a method of manufacturing a heavy-walled high-strength stainless seamless steel tube for oil wells having high strength, excellent corrosion resistance, and excellent low-temperature toughness using the above-mentioned equipment line to manufacture a seamless steel tube.

Steel is heated in the heating device and, thereafter, pierced into a hollow steel tube in the piercing device, cooled in the cooling system and, immediately thereafter, hot worked in the rolling mill or further passed through the thermal insulator after hot working to manufacture a seamless steel tube having a predetermined size.

The steel has a chemical composition comprising by mass %; 0.050% or less C, 0.50% or less Si, 0.20 to 1.80% Mn, 15.5 to 18.0% Cr, 1.5 to 5.0% Ni, 1.0 to 3.5% Mo, 0.02 to 0.20% V, 0.01 to 0.15% N, 0.006% or less O, and Fe and unavoidable impurities as a balance.

First, the reasons for limiting the chemical composition are explained. Unless otherwise specified, mass % is simply indicated by "%".

C: 0.050% or less

C is an important element relating to strength of martensite stainless steel. It is preferable to set the content of C to 0.005% or more to ensure desired strength. On the other hand, when the content of C exceeds 0.050%, sensitization at the time of tempering due to the content of Ni is increased. From a viewpoint of improving corrosion resistance, it is preferable to set the content of C as small as possible. Accordingly, the content of C is limited to 0.050% or less. The content of C is preferably 0.030 to 0.050%.

Si: 0.50% or less

Si is an element functioning as a deoxidizing agent. Therefore, it is preferable to set the content of Si to 0.05% or more. When the content of Si exceeds 0.50%, corrosion resistance is deteriorated and hot workability is also deteriorated. Accordingly, the content of Si is limited to 0.50% or less. The content of Si is preferably 0.10 to 0.30%.

Mn: 0.20 to 1.80%

Mn is an element having a function of increasing strength. It is necessary to set the content of Mn to 0.20% or more to acquire such a strength increasing effect. On the other hand, when the content of Mn exceeds 1.80%, Mn adversely affects toughness. Accordingly, the content of Mn is limited to 0.20 to 1.80%. The content of Mn is preferably 0.20 to 1.0%.

Cr: 15.5 to 18.0%

Cr is an element forming a protective coating and enhances corrosion resistance. Further, Cr is an element present in a solid solution state and thus increases strength of steel. To acquire these effects, it is necessary to set the content of Cr to 15.5% or more. On the other hand, when the content of Cr exceeds 18.0%, hot workability is deteriorated so that strength of steel is further lowered. Accordingly, the content of Cr is limited to 15.5 to 18.0%. The content of Cr is preferably 16.5 to 18.0%.

Ni: 1.5 to 5.0%

Ni is an element having a function of strengthening a protective coating and thus enhancing corrosion resistance. Further, Ni is also an element present in a solid solution state and thus increases strength of steel, and further enhances toughness. These effects can be obtained when the content of Ni is 1.5% or more. On the other hand, when the content of Ni exceeds 5.0%, stability of martensitic phase is deteriorated and strength is lowered. Accordingly, the content of Ni is limited to 1.5 to 5.0%. The content of Ni is preferably 2.5 to 4.5%.

Mo: 1.0 to 3.5%

Mo is an element that improves resistance to pitting corrosion caused by $Cl^-$ (pitting corrosion resistance). It is necessary to set the content of Mo to 1.0% or more to acquire such a pitting corrosion resistance. On the other hand, when the content of Mo exceeds 3.5%, strength is lowered and material cost is sharply pushed up. Accordingly, the content of Mo is limited to 1.0 to 3.5%. The content of Mo is preferably 2 to 3.5%.

V: 0.02 to 0.20%

V is an element that increases strength and improves corrosion resistance. It is necessary to set the content of V to 0.02% or more to acquire these effects. On the other hand, when the content of V exceeds 0.20%, toughness is deteriorated. Accordingly, the content of V is limited to 0.02 to 0.20%. The content of V is preferably 0.02 to 0.08%.

N: 0.01 to 0.15%

N is an element that remarkably enhances pitting corrosion resistance. It is necessary to set the content of N to 0.01% or more to acquire such a pitting corrosion resisting effect. On the other hand, when the content of N exceeds 0.15%, N forms various nitrides and thus deteriorates toughness. The content of N is preferably 0.02 to 0.08%.

O: 0.006% or less

O is present in steel in the form of oxides, and thus adversely affects various properties. Hence, it is preferable to decrease the content of O as much as possible. Particularly, when the content of O exceeds 0.006%, hot workability, toughness and corrosion resistance are remarkably deteriorated. Accordingly, the content of O is limited to 0.006% or less.

The above-mentioned chemical composition is a basic one of steel. In addition, the basic chemical composition may contain, as selective elements, at least one group selected from the following element groups A to D.

Group A: 0.002 to 0.050% Al,

Group B: 3.5% or less Cu,

Group C: at least one element selected from 0.2% or less Nb, 0.3% or less Ti, 0.2% or less Zr, 3.0% or less W and 0.01% or less B Group D: at least one element selected from 0.01% or less Ca and 0.01% or less REM.

Group A: 0.002 to 0.050% Al

Al is an element functioning as a deoxidizing agent. It is preferable to set the content of Al to 0.002% or more to acquire such a deoxidizing effect. However, when the content of Al exceeds 0.050%, Al adversely affects toughness. Accordingly, when the steel contains Al, it is desirable to limit the content of Al to 0.002 to 0.050%. It is more desirable to limit the content of Al to 0.03% or less.

When Al is not added, the presence of approximately less than 0.002% of Al is allowed as an unavoidable impurity.

Group B: 3.5% or less Cu

Cu strengthens a protective film, suppresses intrusion of hydrogen into steel, and improves sulfide stress corrosion cracking resistance. To acquire such effects, it is desirable to set the content of Cu to 0.5% or more. On the other hand, when the content of Cu exceeds 3.5%, the grain boundary precipitation of CuS is brought about. Hence, hot workability is deteriorated. Accordingly, when the steel contains Cu, it is preferable to limit the content of Cu to 3.5% or less. It is more preferable to set the content of Cu to 0.8 to 2.5%.

Group C: at least one element selected from 0.2% or less Nb, 0.3% or less Ti: 0.2% or less Zr, 3.0% or less W and 0.01% or less B All of Nb, Ti, Zr, W and B are elements that increase strength and, therefore, the steel can contain these elements selectively when required. Such a strength increasing effect can be obtained when the steel contains at least one element selected from 0.03% or more Nb, 0.03% or more Ti, 0.03% or more Zr, 0.2% or more W and 0.0005% or more B. On the other hand, when the content of Nb exceeds 0.2%, the content of Ti exceeds 0.3%, the content of Zr exceeds 0.2%, the content of W exceeds 3.0% or the content of B exceeds 0.01%, toughness is deteriorated. Accordingly, when the steel product contains Nb, Ti, Zr, W or B, it is preferable to limit the content of Nb to 0.2% or less, the content of Ti to 0.3% or less, the content of Zr to 0.2% or less, the content of W to 3.0% or less, and the content of B to 0.01% or less respectively.

Group D: at least one element selected from 0.01% or less Ca and 0.01% or less REM Ca and REM function to form the shape of sulfide inclusions into a spherical shape. That is, Ca and REM have an effect of lowering the hydrogen trapping ability of inclusions by decreasing lattice strain of the matrix around the inclusion. The steel can contain at least one element of Ca and REM when necessary. To acquire such a hydrogen trapping ability lowering effect, it is desirable to set the content of Ca to 0.0005% or more and the content of REM to 0.001% or more respectively. On the other hand, when the content of Ca exceeds 0.01% or the content of REM exceeds 0.01%, corrosion resistance is deteriorated. Accordingly, when the steel contains at least one of Ca and REM, it is preferable to limit the content of Ca to 0.01% or less and the content of REM to 0.01% or less respectively.

The balance other than the above-mentioned elements is formed of Fe and unavoidable impurities. The steel is allowed to contain 0.03% or less P and 0.005% or less S as unavoidable impurities.

The method of manufacturing the steel having the above-mentioned chemical composition is not particularly limited. As the steel, it is preferable to use billets (round billets) manufactured such that a molten steel having the above-mentioned chemical composition is prepared using a usual smelting furnace such as a convertor or an electric furnace, and the billets are produced by a usual casting method such as a continuous casting. The steel may be prepared in the form of billets having a predetermined size by hot rolling. Further, there arises no problem when billets are manufactured using an ingot-making and blooming method.

First, a steel having the above-mentioned chemical composition is charged into a heating device, and heated to a temperature falling within a range from 600° C. or above to less than a melting point.

Heating temperature: 600° C. or above to less than a melting point

When the heating temperature is below 600° C., the microstructure is a single phase. Hence, the microstructure cannot be made fine because the phase transformation does not occur. On the other hand, when the heating temperature is the melting point or above, hot working cannot be applied. Accordingly, a heating temperature of steel is limited to a temperature falling within a range from 600° C. or more to less than a melting point. From the viewpoint that deformation resistance is small so that the steel can be easily hot worked or from the viewpoint that large temperature difference can be acquired at the time of cooling the steel, the heating temperature is preferably 1000 to 1300° C. The heating temperature is more preferably 1100 to 1300° C.

Then, the heated steel is pierced into a hollow steel tube in the piercing device.

Provided that the heated steel can be pierced into a hollow steel tube, the piercing condition does not need to be particularly limited, and it is preferable to adopt a usual piercing condition.

Next, the obtained hollow steel tube is cooled in the cooling system.

Cooling is performed such that the hollow steel tube is subjected to accelerated cooling at an average cooling rate of 1.0° C./s or more on the outer surface of the hollow steel tube until a cooling stop temperature of 600° C. or above and in a cooling temperature range of 50° C. or more between a cooling start temperature and the cooling stop temperature. The cooling start temperature is a temperature at the wall thickness center portion of the hollow steel tube before cooling, and is preferably 600° C. or above. It is more preferable to set the cooling start temperature to 1100° C. or above. When the cooling start temperature is below 600° C., an effect of making the microstructure fine by the succeeding hot working cannot be expected.

Cooling temperature range: 50° C. or more

The cooling temperature range (cooling temperature difference), that is, the temperature difference between the cooling start temperature and the cooling stop temperature is 50° C. or more on the outer surface of the hollow steel tube. When the cooling temperature range is less than 50° C., the clear phase distribution in a non-equilibrium state cannot be ensured. Hence, the desired fine microstructure cannot be acquired by hot working performed after cooling. Accordingly, the cooling temperature range of cooling is limited to 50° C. or more. As the cooling temperature range is increased, the phase distribution in a non-equilibrium state can be more easily ensured. The cooling temperature range is preferably 100° C. or more.

Cooling stop temperature: 600° C. or above

The cooling stop temperature is 600° C. or above. When the cooling stop temperature is below 600° C., the diffusion of elements is delayed so that phase transformation ($\alpha \rightarrow \gamma$ transformation) brought about by hot working applied to the hollow steel tube thereafter is delayed. Hence, an advantageous effect of making the microstructure fine as desired by applying hot working to the hollow steel tube cannot be expected. Accordingly, the cooling stop temperature is limited to 600° C. or above. The cooling stop temperature is preferably 700° C. or above. Even when the cooling stop temperature is below 600° C., when the temperature of the hollow steel tube is elevated to 600° C. or above due to radiation heat or working heat generated by hot working applied thereafter, it is possible to acquire an effect of making the microstructure fine.

Average cooling rate: 1.0° C./s or more

When an average cooling rate in cooling is less than 1.0° C./s, the phase distribution in a non-equilibrium state cannot be ensured. Hence, the desired fine microstructure cannot be acquired by hot working performed after cooling. Accordingly, the average cooling rate is limited to 1.0° C./s or more. An upper limit of the cooling rate is determined based on a capacity of the cooling system. Although it is unnecessary to particularly define an upper limit of the cooling rate, from a viewpoint of preventing the occurrence of cracks or bending due to thermal stress, it is preferable to set the upper limit of the cooling rate to 30° C./s or less. It is more preferable to set the upper limit of the cooling rate to 3 to 10° C./s.

Next, the cooled hollow steel tube is subjected to hot working in the rolling mill so that the hollow steel tube is formed into a seamless steel tube having a predetermined size. The time from a point where the cooling is finished to a point where the hot working is applied to the hollow steel tube is preferably 600 s or less. When this time is prolonged and exceeds 600 s, ferrite phase is transformed into austenitic phase. Hence, it is difficult to ensure a non-equilibrium state.

It is unnecessary to particularly limit the cooling rate after hot working. However, when cooling is performed at an average cooling rate exceeding 20° C./s with respect to a temperature at the wall thickness center portion, it is preferable to adjust the average cooling rate to 20° C./s or less in the thermal insulator arranged on an exit side of the rolling mill. When the cooling rate after hot working exceeds 20° C./s, the precipitation of austenitic phase due to the transformation from α to γ is delayed so that the hollow steel tube is cooled without precipitating the austenitic phase. Accordingly, the microstructure after hot working is frozen. Hence, the microstructure cannot be made fine in a desired manner.

The explanation has been made heretofore with respect to when the equipment line in which the cooling system is arranged between the piercing device and the rolling mill is used. However, even when the equipment line in which the cooling system is arranged between the heating device and the piercing device is used, the same advantageous effect can be achieved. This is because it is confirmed that a working mode of hot working only slightly affects the advantageous effects.

In use of the equipment line in which the cooling system is arranged between the heating device and the piercing device, it is necessary to set the cooling stop temperature depending on the chemical composition of steel such that the piercing can be performed. Within the chemical composition of the steel, it is preferable to set the cooling stop temperature to 600° C. or above. When the cooling stop temperature is below 600° C., deformation resistance becomes excessively high so that the piercing becomes difficult. Accordingly, it is preferable to limit the cooling stop temperature to 600° C. or above. To ensure the phase distribution in a non-equilibrium state in cooling the heated steel, it is preferable to set a cooling rate on the outer surface of steel to 1.0° C./s or above on average.

A seamless steel tube acquired by the above-mentioned manufacturing method is a steel tube having the above-mentioned composition and also having a microstructure constituted of martensitic phase as a main phase, ferrite phase and/or residual austenitic phase. "Main phase" is a phase having the largest area ratio. It is preferable that the content of the residual austenitic phase is 20% or less with respect to the area ratio. The steel tube having such a microstructure becomes a steel tube having high strength where yield strength is 654 MPa or more, excellent low-temperature toughness where absorbed energy at a test temperature of −40° C. in Charpy impact test at the wall thickness center portion is 50 J or more, and excellent corrosion resistance in a severe corrosion environment containing carbon dioxide at a high temperature of 230° C.

Next, equipment lines and methods are further explained based on an example.

EXAMPLE

Molten Steels having the chemical compositions shown in Table 1 were prepared by a converter and cast into billets using a continuous casting method. The billets were subjected to roll forming to produce round billets (230 mmϕ) having the chemical compositions shown in Table 1. Heavy-walled seamless steel tubes (outer diameter: 273 mmϕ), wall thickness: 32 mm) were manufactured using the round billets.

The round billets were charged into the heating device 1 of the equipment line shown in FIG. 1A, heated to heating temperatures shown in Table 2 and held for a fixed time (60 min). Thereafter, the round billets were pierced into hollow steel tubes (wall thickness: approximately 50 mm) using the Mannesmann barrel roll type piercing machine 2. The hollow steel tubes were cooled to cooling stop temperatures shown in Table 2 at average cooling rates shown in Table 2 by spraying cooling water as a refrigerant in the cooling system 4. Immediately after cooling, the hollow steel tubes were rolled at cumulative rolling reduction ratios shown in Table 2 into seamless steel tubes (outer diameter: 273 mmϕ), wall thickness: 25 to 50 mm) in the rolling mill 3 where the elongator, the plug mill, the reeler and the sizer are sequentially arranged. After rolling was finished, the seamless steel tubes were naturally cooled (0.1 to 1.5° C./s). Heat treatment (quenching and tempering or tempering) was further applied to the manufactured heavy-walled seamless steel tubes.

Specimens were sampled from the heavy-walled seamless steel tubes and the observation of microstructure, the tensile test and the impact test were carried out. The following testing methods were used.

(1) Observation of Microstructure

Specimens for microstructure observation were sampled from the steel tubes. Cross sections (C cross sections) orthogonal to the tube longitudinal direction were polished and corroded (corrosion liquid: vilella liquid). The microstructure was observed using an optical microscope (magnification: 100 times) or a scanning electron microscope (magnification: 1000 times), and the microstructure was imaged, and the kind and fraction of the microstructure were measured using an image analysis. As an index to determine whether or not the microstructure was made fine, as a size index of crystal grains, the number of boundaries of crystal grains which intersect with a straight line of a unit length was measured from the microstructure photographs. The acquired values of the number of boundaries of crystal grains per unit length is indicated as a ratio with respect to a reference value (phase boundary number ratio) by setting a value of steel tube No. 5 as the reference (1.00).

(2) Tensile Test

Round bar type tensile specimens (parallel portion: 6 mmϕ×G.L. 20 mm) were sampled from the acquired steel tubes such that the tube-axis direction is aligned with the tensile direction, a tensile test was carried out, and yield strength YS was obtained with respect to each specimen. The yield strength is a strength at the elongation of 0.2%.

(3) Impact Test

V-notched test bar specimens were sampled from the wall thickness center portion of the acquired steel tubes such that the tube-axis direction was aligned with the longitudinal direction of specimen, and a Charpy impact test was carried out in accordance with the provisions of JIS Z 2242. The absorbed energy at a test temperature of −40° C. ($vE_{-40}$) was measured and the toughness of each specimen was evaluated. Three specimens were prepared, and an average value of absorbed energies was set as $vE_{-40}$ of the steel tube.

The results are shown in Table 3.

TABLE 1

| Steel No. | Chemical composition (mass %) C | Si | Mn | P | S | Cr | Ni | Mo | V | Al | Cu | Nb, Ti, Zr, W, B | Ca, REM | N | O |
|---|---|---|---|---|---|---|---|---|---|---|---|---|---|---|---|
| A | 0.016 | 0.20 | 0.26 | 0.01 | 0.002 | 16.5 | 3.4 | 1.5 | 0.047 | 0.013 | 0.89 | — | — | 0.044 | 0.0030 |
| B | 0.021 | 0.19 | 0.36 | 0.01 | 0.001 | 17.4 | 3.6 | 2.5 | 0.055 | 0.012 | — | Nb: 0.066 | — | 0.056 | 0.0022 |
| C | 0.026 | 0.21 | 0.28 | 0.02 | 0.001 | 17.5 | 2.3 | 2.3 | 0.044 | 0.013 | 0.80 | — | REM: 0.01 | 0.063 | 0.0033 |
| D | 0.023 | 0.20 | 0.37 | 0.02 | 0.001 | 16.7 | 3.8 | 1.8 | 0.037 | 0.013 | 1.25 | — | Ca: 0.002 | 0.043 | 0.0029 |
| E | 0.021 | 0.20 | 0.34 | 0.02 | 0.001 | 17.9 | 3.5 | 1.9 | 0.050 | 0.016 | — | — | Ca: 0.001 | 0.038 | 0.0026 |
| F | 0.019 | 0.22 | 0.30 | 0.02 | 0.001 | 15.5 | 4.0 | 2.3 | 0.045 | 0.014 | 0.75 | Nb: 0.045 | — | 0.050 | 0.0018 |
| G | 0.047 | 0.35 | 0.26 | 0.01 | 0.001 | 17.3 | 0.9 | 2.1 | 0.055 | 0.022 | — | — | — | 0.061 | 0.0016 |
| H | 0.018 | 0.22 | 0.32 | 0.01 | 0.001 | 16.7 | 3.5 | 2.5 | 0.052 | 0.002 | — | — | — | 0.052 | 0.0025 |
| I | 0.027 | 0.22 | 0.27 | 0.01 | 0.001 | 16.5 | 3.7 | 2.2 | 0.047 | 0.010 | 0.06 | Nb: 0.075, W: 2.3, Ti: 0.1 | — | 0.050 | 0.0030 |

TABLE 2

| Steel plate No. | Steel No. | Heating Heating temperature (° C.) | Cooling after piercing: Cooling start temperature (° C.) | Average cooling rate (° C./s) | Cooling stop temperature (° C.) | Cooling temperature range (° C.) | Rolling Cumulative rolling reduction ratio (%) | Cooling after rolling Average cooling rate (° C./s) | Heat treatment temperature Quenching (° C.) | Tempering (° C.) | Remarks |
|---|---|---|---|---|---|---|---|---|---|---|---|
| 1 | A | 1250 | 1250 | 0.5 | 1200 | 50 | 50 | 1.5 | 950 | 600 | Comparison example |
| 2 | A | 1250 | 1250 | 0.5 | 1200 | 50 | 10 | 0.3 | 950 | 600 | Comparison example |
| 3 | A | 1250 | 1250 | 0.5 | 1195 | 55 | 36 | 0.4 | 950 | 600 | Comparison example |
| 4 | A | 1250 | 1250 | 0.5 | 1005 | 245 | 36 | 0.4 | 950 | 600 | Comparison example |
| 5 | A | 1250 | 1250 | 0.5 | 900 | 350 | 36 | 0.4 | 950 | 600 | Comparison example |
| 6 | A | 1250 | 1250 | 0.5 | 635 | 615 | 36 | 0.4 | 950 | 600 | Comparison example |
| 7 | A | 1250 | 1250 | 5.0 | 1205 | 45 | 36 | 0.4 | 950 | 600 | Comparison example |
| 8 | A | 1250 | 1250 | 0.5 | 900 | 350 | 36 | 0.4 | 950 | 600 | Comparison example |
| 9 | A | 1250 | 1250 | 1.1 | 910 | 340 | 36 | 0.4 | 950 | 600 | Example |
| 10 | A | 1250 | 1250 | 8.9 | 895 | 355 | 36 | 0.4 | 950 | 600 | Example |
| 11 | A | 1250 | 1250 | 12.5 | 890 | 360 | 36 | 0.4 | 950 | 600 | Example |
| 12 | A | 1250 | 1250 | 12.5 | 895 | 355 | 0 | 0.12 | 950 | 600 | Example |
| 13 | A | 1250 | 1250 | 10.5 | 615 | 635 | 36 | 0.4 | 950 | 600 | Example |
| 14 | A | 1150 | 1150 | 1.2 | 1095 | 55 | 36 | 0.4 | 950 | 600 | Example |
| 15 | A | 1150 | 1150 | 8.9 | 1095 | 55 | 36 | 0.4 | 950 | 600 | Example |
| 16 | A | 1150 | 1150 | 12.5 | 1085 | 65 | 36 | 0.4 | 950 | 600 | Example |
| 17 | A | 1250 | 1250 | 12.5 | 915 | 335 | 36 | 25 | 950 | 600 | Comparison example |
| 18 | B | 1250 | 1250 | 0.5 | 1000 | 250 | 36 | 0.4 | 950 | 600 | Comparison example |
| 19 | B | 1250 | 1250 | 8.9 | 995 | 255 | 36 | 0.4 | 950 | 600 | Example |
| 20 | C | 1250 | 1250 | 0.5 | 1000 | 250 | 36 | 0.4 | 950 | 600 | Comparison example |
| 21 | C | 1250 | 1250 | 10.5 | 950 | 300 | 36 | 0.4 | 950 | 600 | Example |
| 22 | D | 1250 | 1250 | 0.5 | 1000 | 250 | 36 | 0.4 | 950 | 600 | Comparison example |
| 23 | D | 1250 | 1250 | 5.5 | 995 | 255 | 36 | 0.4 | 950 | 600 | Example |
| 24 | E | 1250 | 1250 | 0.5 | 1000 | 250 | 36 | 0.4 | 950 | 600 | Comparison example |
| 25 | E | 1250 | 1250 | 7.0 | 1010 | 240 | 36 | 0.4 | 950 | 600 | Example |
| 26 | F | 1250 | 1250 | 0.5 | 995 | 255 | 36 | 0.4 | 950 | 600 | Comparison example |
| 27 | F | 1250 | 1250 | 7.5 | 995 | 255 | 36 | 0.4 | 950 | 600 | Example |
| 28 | G | 1250 | 1250 | 0.5 | 1000 | 250 | 36 | 0.4 | 950 | 600 | Comparison example |
| 29 | G | 1250 | 1250 | 8.0 | 1005 | 245 | 36 | 0.4 | 950 | 600 | Example |
| 30 | H | 1250 | 1250 | 0.5 | 995 | 255 | 36 | 0.4 | 950 | 600 | Comparison example |

TABLE 2-continued

| Steel plate No. | Steel No. | Heating Heating temperature (° C.) | Cooling after piercing: Cooling start temperature (° C.) | Cooling after piercing: Average cooling rate (° C./s) | Cooling after piercing: Cooling stop temperature (° C.) | Cooling after piercing: Cooling temperature range (° C.) | Rolling Cumulative rolling reduction ratio (%) | Cooling after rolling Average cooling rate (° C./s) | Heat treatment temperature: Quenching (° C.) | Heat treatment temperature: Tempering (° C.) | Remarks |
|---|---|---|---|---|---|---|---|---|---|---|---|
| 31 | H | 1250 | 1250 | 8.9 | 995 | 255 | 36 | 0.4 | 950 | 600 | Example |
| 32 | I | 1250 | 1250 | 0.5 | 1090 | 160 | 36 | 0.4 | 950 | 600 | Comparison example |
| 33 | I | 1250 | 1250 | 9.0 | 1040 | 210 | 36 | 0.4 | 950 | 600 | Example |

TABLE 3

| Steel plate No. | Steel No. | Microstructure: Kind * | Microstructure: Phase boundary number ratio | Tensile property: Yield strength (M Pa) | Toughness: $vE_{-40}$ (J) | Remarks |
|---|---|---|---|---|---|---|
| 1 | A | M + F + Residual γ | 0.81 | 795 | 31 | Comparison example |
| 2 | A | M + F + Residual γ | 0.21 | 790 | 7 | Comparison example |
| 3 | A | M + F + Residual γ | 0.94 | 815 | 15 | Comparison example |
| 4 | A | M + F + Residual γ | 0.96 | 815 | 22 | Comparison example |
| 5 | A | M + F + Residual γ | 1.00 | 815 | 35 | Comparison example |
| 6 | A | M + F + Residual γ | 0.77 | 800 | 35 | Comparison example |
| 7 | A | M + F + Residual γ | 0.83 | 800 | 33 | Comparison example |
| 8 | A | M + F + Residual γ | 0.82 | 805 | 37 | Comparison example |
| 9 | A | M + F + Residual γ | 2.83 | 825 | 90 | Example |
| 10 | A | M + F + Residual γ | 9.53 | 855 | 111 | Example |
| 11 | A | M + F + Residual γ | 11.85 | 875 | 122 | Example |
| 12 | A | M + F + Residual γ | 8.95 | 865 | 115 | Example |
| 13 | A | M + F + Residual γ | 3.25 | 835 | 99 | Example |
| 14 | A | M + F + Residual γ | 2.78 | 830 | 75 | Example |
| 15 | A | M + F + Residual γ | 2.95 | 840 | 82 | Example |
| 16 | A | M + F + Residual γ | 3.15 | 840 | 99 | Example |
| 17 | A | M + F + Residual γ | 0.31 | 615 | 6 | Comparison example |
| 18 | B | M + F + Residual γ | 0.95 | 795 | 32 | Comparison example |
| 19 | B | M + F + Residual γ | 9.95 | 885 | 125 | Example |
| 20 | C | M + F + Residual γ | 0.88 | 805 | 27 | Comparison example |
| 21 | C | M + F + Residual γ | 10.35 | 910 | 121 | Example |
| 22 | D | M + F + Residual γ | 0.99 | 810 | 33 | Comparison example |
| 23 | D | M + F + Residual γ | 7.92 | 930 | 135 | Example |
| 24 | E | M + F + Residual γ | 0.92 | 800 | 34 | Comparison example |
| 25 | E | M + F + Residual γ | 8.59 | 875 | 112 | Example |
| 26 | F | M + F + Residual γ | 0.87 | 810 | 35 | Comparison example |
| 27 | F | M + F + Residual γ | 1.91 | 805 | 120 | Example |
| 28 | G | M + F + Residual γ | 0.69 | 645 | 15 | Comparison example |
| 29 | G | M + F + Residual γ | 1.99 | 630 | 112 | Comparison example |
| 30 | H | M + F + Residual γ | 0.86 | 795 | 33 | Comparison example |
| 31 | H | M + F + Residual γ | 9.25 | 885 | 111 | Example |
| 32 | I | M + F + Residual γ | 0.89 | 795 | 29 | Comparison example |
| 33 | I | M + F + Residual γ | 8.80 | 815 | 66 | Example |

* M: martensite,
F: ferrite, Residual
γ: Residual austenite

In all of our examples, the microstructure of the steel tube can be made fine even at the wall thickness center portion of the heavy-walled steel tube, and toughness of the steel tube is remarkably improved such that absorbed energy at a test temperature of −40° C. in a Charpy impact test is 50 J or more in spite of the fact that the steel tube has a yield strength of 654 MPa or more. Our example (steel tube No. 12) having a relatively low working amount (cumulative rolling reduction ratio) of 0% also exhibits remarkably improved toughness. On the other hand, the comparison examples do not have desired high strength or desired high toughness since the microstructure is not made fine.

What is claimed is:

1. A method of manufacturing a high-strength stainless seamless steel tube with an equipment line comprising:

a heating device, a piercing device, a rolling mill, a cooling system, which is arranged between the heating device and the piercing device or between the piercing device and the rolling mill, and a thermal insulator, which is arranged on an exit side of the rolling mill, the method comprising;

heating steel in the heating device, piercing the steel in the piercing device into a hollow steel tube, cooling the hollow steel tube in the cooling system, forming the hollow steel tube in the rolling mill into a seamless steel tube having a predetermined size, and passing the seamless steel tube through the thermal insulator, wherein:

the steel has a chemical composition consisting of by mass %, 0.050% or less C, 0.50% or less Si, 0.20 to 1.80% Mn, 15.5 to 18.0% Cr, 1.5 to 5.0% Ni, 1.0 to 3.5% Mo, 0.02 to 0.20% V, 0.01 to 0.15% N, 0.006% or less O, and Fe and unavoidable impurities as a balance, the heating in the heating device is performed such that the steel is heated to a temperature within a range from 650° C. to a temperature below a melting point of the steel, the cooling in the cooling system is performed such that the hollow steel tube after piercing is subjected to cooling at an average cooling rate of 1.0° C./s or more on an outer surface of steel until a cooling stop temperature of 600° C. or above and in a cooling temperature range of 50° C. or more between a cooling start temperature and the cooling stop temperature, and the passing through the thermal insulator is performed such that a cooling rate of the seamless steel tube is slowed down to an average cooling rate of 20° C./s or less.

2. The method according to claim 1, wherein the chemical composition further contains by mass %, at least one group selected from groups A to D;

Group A: 0.002 to 0.050% Al,

Group B: 3.5% or less Cu,

Group C: at least one element selected from 0.2% or less Nb, 0.3% or less Ti, 0.2% or less Zr, 3.0% or less Wand 0.01% or less B, Group D: at least one element selected from 0.01% or less Ca, and 0.01% or less REM.

* * * * *